US006372180B1

(12) United States Patent
Kemeny

(10) Patent No.: US 6,372,180 B1
(45) Date of Patent: Apr. 16, 2002

(54) METHOD OF MAKING MG TREATED IRON WITH IMPROVED MACHINABILITY

(75) Inventor: Frank L. Kemeny, Trails End, NY (US)

(73) Assignee: Sintercast AB, Stockholm (SE)

( * ) Notice: Subject to any disclaimer, the term of this patent is extended or adjusted under 35 U.S.C. 154(b) by 0 days.

(21) Appl. No.: 09/622,667

(22) PCT Filed: Mar. 5, 1999

(86) PCT No.: PCT/SE99/00335

§ 371 Date: Aug. 22, 2000

§ 102(e) Date: Aug. 22, 2000

(87) PCT Pub. No.: WO99/45156

PCT Pub. Date: Sep. 10, 1999

(30) Foreign Application Priority Data

Mar. 6, 1998 (SE) ..... 9800750

(51) Int. Cl.[7] ..... C22C 33/10
(52) U.S. Cl. ..... 420/22; 75/568
(58) Field of Search ..... 420/22; 75/568

(56) References Cited

U.S. PATENT DOCUMENTS 2,870,004 A * 1/1959 Estes et al. ..... 420/22
3,309,197 A * 3/1967 Kusaka ..... 420/22
4,292,075 A * 9/1981 Wolfsgruber et al. ..... 420/22
4,889,688 A * 12/1989 Suenaga et al. ..... 420/22

FOREIGN PATENT DOCUMENTS

SE 466 059 12/1991
SE 502 227 9/1995

* cited by examiner

*Primary Examiner*—Deborah Yee
(74) *Attorney, Agent, or Firm*—Pillsbury Winthrop LLP

(57) ABSTRACT

A process of producing magnesium-treated iron such as spheroidal graphite iron (SGI), compacted graphite cast iron (CGI) containing inclusions that deform plastically during machining, said process comprising the steps of: a) producing base iron; b) desulfurizating the base iron produced in step a) with a magnesium free reagent, if it is sulfur concentration exceeds 0.02 % (wt.); c) controlling the oxygen potential and temperature of the base iron to facilitate silicon control of oxygen, if the amount of oxygen exceeds 10 ppm; d) adding aluminum, calcium and/or calcium-containing oxides to the base iron in amounts designed to form dicalcium aluminate deoxidation product or low melting point calcium aluminum silicate deoxidation product; e) treating the base iron with magnesium containing inoculant to attain desired condition for desired nodularity; and f) continuing the process of producing magnesium-treated iron in a per se known manner.

8 Claims, No Drawings

METHOD OF MAKING MG TREATED IRON WITH IMPROVED MACHINABILITY

Cast iron is made in various grades that can be categorized by the graphite morphology. In the case of gray iron castings, the flaked graphite structure is predominant. Theses iron grades are not treated with magnesium and the dissolved oxygen content is controlled by the silicon-manganese complex deoxidation equilibrium. This control results in nonmetallic oxide inclusions that are plastic at temperatures present during machining. The deformable nature of these manganese silicate inclusions is in part responsible for the free machining behavior of gray cast iron.

In the case of magnesium treated iron, the oxygen is controlled by the magnesium-oxygen equilibrium, and the resulting non-metallic inclusions are magnesium silicates or magnesium oxide. These inclusions are not plastic at the temperatures attained during any machining process. Therefore, they are not useful in the processes of tool lubrication or chip formation.

The object of the present invention is to create a population of deformable inclusions in Mg treated iron that will improve the machining properties of these iron grades. This is accomplished by manipulating the control of oxygen in the process so the magnesium equilibria only have control in the final stage prior to casting.

The present process of making Mg treated iron involves making a "gray iron" type base metal with the required alloy concentrations. This iron is then desulfurized using calcium carbide or magnesium reagents, if the iron contains more than 0.02% (wt.) sulfur. Preferably, the iron does not contain more than 0.008% (wt.) sulfur. The oxygen content is also reduced by this step to a level where the maganese silicon deoxidation is no longer in control. The iron should not contain more than 10 ppm oxygen, preferably not more than 5 ppm oxygen. The iron is then further treated with inoculants designed to reduce oxygen potential and to increase inclusion population. Inoculants suitable for the purpose of the present invention are inoculants consisting of CaO, $CaC_2$ and/or alumina. The level of magnesium injection, combined with other controlling aspects, determines the amount of nodularily that will be present upon solidification. In any case, the oxygen is now controlled by the magnesium silicate inclusions.

To improve the machinability of Mg treated iron, it is necessary to provide deoxidation prior to magnesium injection, making the product of such deoxidation deformable under conditions of machining. It is suggested that a process comprising at least some of the following steps will accomplish this goal:

1. Deoxidize and desulfirize the base iron with a calcium carbide mixture containing no Mg, if necessary
2. Skim the slag formed by the deoxidation and desulfurization products, if necessary.
3. Measure the oxygen potential and temperature.
4. Add mill scale or other oxygen source and/or raise temperature to adjust oxygen potential as required to assure silicon control.
5. Add aluminum and calcium or calcium-containing oxides to dissolved levels so that the products of deoxidation are primarily calcium aluminates or calcium aluminum silicates that are plastic.
6. Inject Mg containing inoculant for control of morphology as required just prior to casting the iron.

The relative amounts of the dissolved aluminum, calcium, and oxides required in step 5 above will depend on temperature and chemistry of the iron at the time of addition. The aim inclusion composition will be that of low melting point plastic calcium aluminum silicate as can be seen in the silica alumina lime ternary phase diagram. Calcium may also act to modify other inclusions present in the iron, such as silicates.

The modification of the desired inclusions by magnesium will occur to some extent but is limited by kinetic factors. With controlled addition time, the modification may actually be beneficial since some magnesia may reduce the liquidus temperature of the inclusion.

Accordingly, the invention relates to a process of producing magnesium-treated iron such as spheroidal graphite iron (SGI), compacted graphite cast iron (CGI) containing inclusions that deform plastically during machining, said process comprising the steps of:

a) producing base iron;
b) desulfurizating, the base iron produced in step a) with a magnesium free reagent, if it is sulfur concentration exceeds 0.02% (wt.);
c) controlling the oxygen potential and temperature of the base iron to facilitate silicon control of oxygen, if the amount of oxygen exceeds 10 ppm;
d) adding aluminum, calcium and/or calcium-containing oxides to the base iron in amounts designed to form dicalcium aluminate deoxidation product or low melting point calcium aluminum silicate deoxidation product;
e) treating the base iron with magnesium containing inoculant to attain desired condition for desired nodularity; and
f) continuing the process of producing magnesium-treated iron in a per se known manner.

In a preferred embodiment, the desulfurizing reagent which is added in step b) contains less than 1% Mg, 0–50% Al, 0–30% Ca, 0–50% CaO, 0–100% $CaC_2$, with the proviso that the sum of the percentages of Al, Ca, CaO and $CaC_2$ is larger than 0% and that the sum of the percentages of all said constituents does not exceed 100%. Preferably, the ratio of calcium added in step d) to total oxygen is between 1 and 20.

It is also advantageous to carry out step c) at an iron temperature of at least 1400° C. and at a dissolved oxygen content of more than 5 ppm.

Preferably, the chemistry of the initial deoxidation product inclusions formed after the addition in step d) is about 50% lime and 50% alumina. The chemistry of the final deoxidation product inclusions is preferably about 50% silica, 10% alumina, 25% calcia and 15% magnesia.

In a preferred embodiment, desuililrization step b) is carried out if the amount of sulfur exceeds 0.008% (wt.).

What is claimed is:

1. A process for producing magnesium-treated iron containing inclusions that deform plastically during machining, said process comprising the steps of:

a) producing base iron;
b) desulfinrizating the base iron produced in step a) with a reagent containing less than 1% magnesium, if its sulfur concentration exceeds 0.02% by wt;
c) controlling the oxygen potential and temperature of the base iron to facilitate silicon control of oxygen, if the amount of oxygen exceeds 10 ppm;
d) adding aluminum, calcium and/or calcium-containing oxides to the base iron in amounts designed to form dicalcium aluminate deoxidation product or low melting point calcium aluminum silicate deoxidation product; and e) treating the base iron with magnesium-containing inoculant to attain predetermined treating condition for predetermined nodularity.

2. A process according to claim 1 where the desulfurizing reagent which is added to step b) contains 0–50% Al, 0–30% Ca, 0–50% CaO, 0–100% $CaC_2$, with the proviso that the sum of the percentages of all said constituents does not exceed 100%.

3. A process according to claim 1 or claim 2, where the ratio of calcium added in step d) to total oxygen is between 1 and 20.

4. A process according to claim 1, where the iron temperature in step c) is raised to at least 1400° C., and where the dissolved oxygen content is higher than 5 ppm.

5. A process according to claim 1, where the chemistry of the initial deoxidation product inclusions formed in step d) is about 50% lima and 50% alumina.

6. A process according to claim 1, where the chemistry of the final deoxidation product inclusions in about 50% silica, 10% alumina, 25% calcium oxide and 15% magnesia.

7. A process according to claim 1, wherein the desulfurization step b) is carried out if the amount of sulfur exceeds 0.008% (wt.).

8. A process according to claim 1, wherein the magnesium-treated iron is as spheroidal graphite iron (SGI) or compacted graphite cast iron (CGI).

* * * * *